United States Patent [19]

Mace

[11] Patent Number: 4,846,755

[45] Date of Patent: Jul. 11, 1989

[54] VIBRATORY SPINNING TOY

[76] Inventor: John A. Mace, 24 Hunting Ridge Rd., Stamford, Conn. 06903

[21] Appl. No.: 100,124

[22] Filed: Sep. 23, 1987

[51] Int. Cl.[4] ..... A63H 1/02

[52] U.S. Cl. ..... 446/239

[58] Field of Search ..... 446/239, 240, 241; 40/427, 613

[56] References Cited

U.S. PATENT DOCUMENTS

| | | | |
|---|---|---|---|
| 664,382 | 12/1900 | Chapman | 446/240 |
| 1,115,575 | 11/1914 | Roba | 446/241 |
| 1,268,998 | 6/1918 | Rankert | 446/239 |
| 1,642,906 | 9/1927 | Suggs | 40/613 |
| 1,978,548 | 10/1934 | Moffitt | 446/239 |
| 3,063,191 | 11/1962 | Main | 446/239 |
| 4,012,864 | 3/1977 | Lister | 446/239 |

*Primary Examiner*—Robert A. Hafer
*Assistant Examiner*—Michael Brown
*Attorney, Agent, or Firm*—St, Onge, Steward, Johnston & Reens

[57] ABSTRACT

A vibratory spinning toy, more particularly, a toy that has a body having a plurality of upraised projections formed thereon and a post projecting therefrom; and a propeller is presented.

14 Claims, 2 Drawing Sheets

FIG. 1
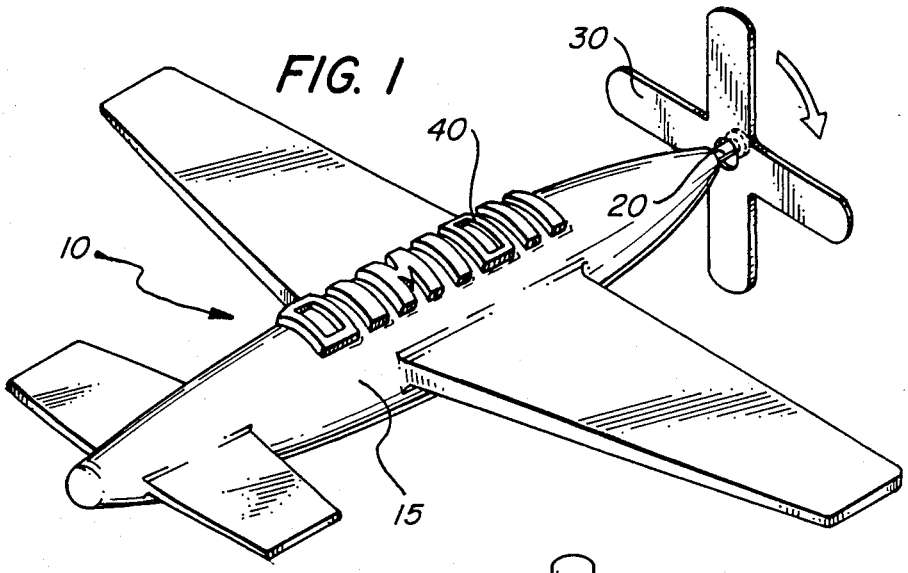
FIG. 2
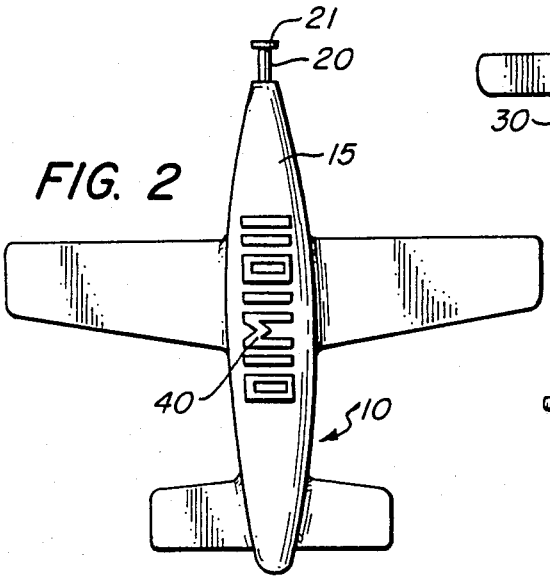
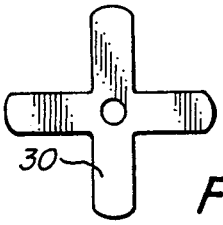
FIG. 3
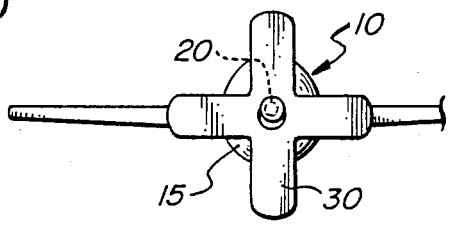
FIG. 4
FIG. 5
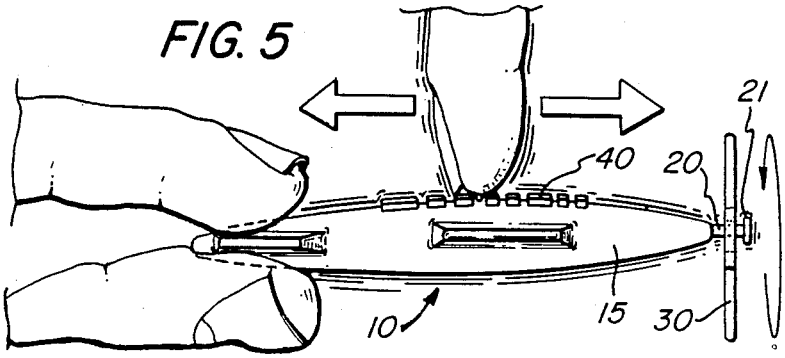

VIBRATORY SPINNING TOY

TECHNICAL FIELD

The present invention relates to a vibratory spinning toy which comprises a body having a plurality of upraised projections formed therein and having a post projecting therefrom; and a propeller which preferably comprises a cross-shaped member comprising a plurality of transverse elements and having a centrally disposed opening, the propeller being mounted on the post for use.

Airplanes and like devices with spinning "propeller" type members have long been popular as children's toys. Moreover, inexpensive toys are often incorporated in children's food packages to encourage the purchasing of the food. An inexpensive toy in the form of an airplane or like device having a spinning propeller would be highly desirable for inclusion in children's food packages because they would provide a great incentive for purchase of the food.

Unfortunately, however, airplane toys having spinning propellers have suffered from either being too expensive to manufacture, inappropriately sized for inclusion in a food package, not easily operable by a child, or all three.

DISCLOSURE OF INVENTION

One object of the present invention is to provide a toy which can be easily operated and inexpensive to manufacture.

Another object of the present invention is to provide a toy which is appropriately sized for inclusion in a food package.

Yet another object of the present invention is to provide a toy which has as an element thereof a spinning propeller and which is easily operated and inexpensive to manufacture.

These and other objects which will be apparent to the skilled artisan upon reading this disclosure are achieved by the provision of the present invention, which relates to a vibratory spinning toy. More particularly, the present invention relates to a vibratory spinning toy which comprises a body having a plurality of upraised projections formed thereon and having a post projecting therefrom; and a propeller having a centrally disposed opening.

BRIEF DESCRIPTION OF THE DRAWINGS

The present invention will be better understood and its advantages more apparent in view of the following detailed description, especially when read with reference to the appended drawings, wherein:

FIG. 1 is an isometric view of one embodiment of the vibratory spinning toy of the present invention;

FIG. 2 is an elevated plan view of the vibratory spinning toy of FIG. 1;

FIG. 3 is a front plan view of the propeller of the vibratory spinning toy of FIG. 1;

FIG. 4 is a front plan view of the vibratory spinning toy of FIG. 1;

FIG. 5 is a side plan view of the vibratory spinning toy of FIG. 1 while in use;

DETAILED DESCRIPTION OF THE PREFERRED EMBODIMENT

Figure 6:
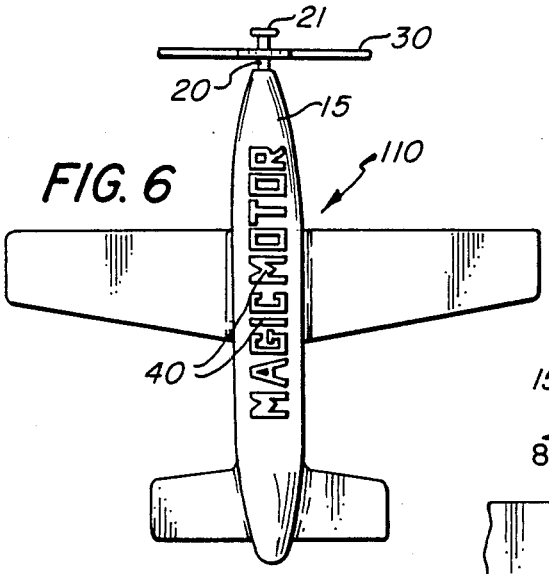
FIG. 6 is an elevated plan view of another embodiment of the vibratory spinning toy of the present invention.

Referring to the drawings, a vibratory spinning toy, in accordance with the present invention, is generally indicated by the reference numeral 10. It will be understood that drawing figures having reference numerals 110, 210 , 310, etc. refer to different embodiments of vibratory spinning toy 10, each of which is equally contemplated by the present invention and that unless otherwise noted, all elements of vibratory spinning toy 10 have corresponding elements of the alternate embodiments 110, 210, 310, etc. It should be noted that for the sake of clarity all the components and and parts of vibratory spinning toy 10 are not shown and/or marked in all the drawings or other embodiments.

Figure 7:
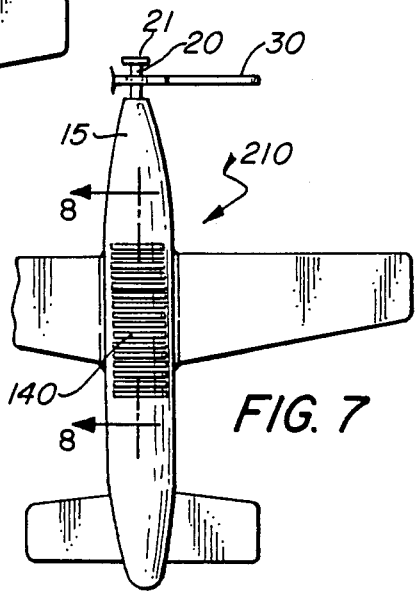
FIG. 7 is an elevated plan view of another embodiment of the vibratory spinning toy of the present invention.
Figure 8:
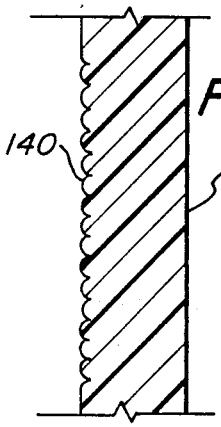
FIG. 8 is a side view in cross section of a portion of the vibratory spinning toy of FIG. 7.
Figure 9:
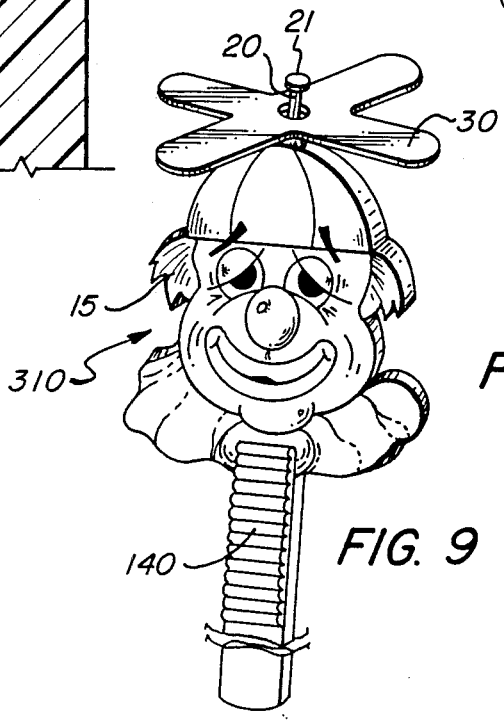
FIG. 9 is an isometric view of another embodiment of the vibratory spinning toy of the present invention.
Figure 10:
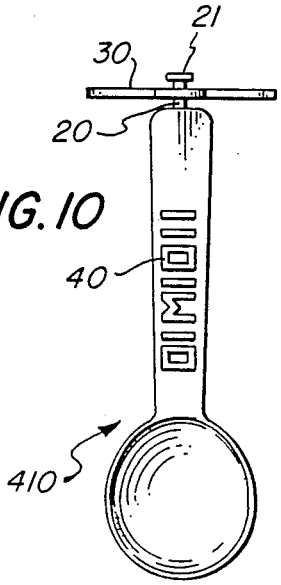

As used in this description, the terms "front" or "top" refers to, respectively, the nose of the airplane shape of FIGS. 1–8, and the head of the character of FIG. 9. Similarly, the terms "back" or "bottom" refers to, respectively, the tail of the airplane shape of FIGS. 1–8, and the end opposite the head of the character of FIG. 9. Furthermore, the terms "up" and "down" refer to the vibratory spinning toy of this invention when in the orientation illustrated in FIG. 9, although it will be recognized that vibratory spinning toy 10, 110, 210, 310, etc. can assume various orientations during actual use.

Materials which are useful in forming vibratory spinning toy 10 can be any material which is capable of substantially maintaining a vibration along an axial length. Suitable materials include metals, plastics, even certain hard rubbers. Most preferred are plastics, such as polyethylene and polypropylene because of the economy and ease with which they can be formed into the desired shape, i.e., by molding by conventional molding techiques.

Vibratory spinning toy 10 comprises a body 15 which can be in any desired shape, but is preferably a shape for which association with a propeller is appropriate, such as an airplane, a helicopter or a character wearing a beanie or other cap or hat, as illustrated in FIGS. 1 and 9. Furthermore, body 15 can also be an object in everyday usage, such as an eating utensil like a spoon or fork. In this way, vibratory spinning toy 10 can be used to occupy or amuse a child during means or even encourage a recalcitrant child to the dinner table. Regardless of the functional or decorative nature of the shape of vibratory spinning toy 10, it is preferred that body 15 have a shape which provides a longitudinal axis, front to back to facilitate the transmission of vibration in the appropriate direction, as discussed in more detail below.

Projecting from the front or top of body 15 is a post 20 which can alternatively be described as a rod-like extension, as illustrated in FIGS. 2 and 5. Post 20 can be attached to body 15 by any suitable means for adherence, such as a glue or cement, as would be conventionally known. Advantageously, post 20 is formed integrally on body 15, such as by molding body 15 and post 20 as a single unit. This can be accomplished by traditional molding methods which will be familiar to the skilled artisan. Post 20 preferably has a butt end 21 in order to maintain a propeller on post 20, as will be discussed in more detail below. Butt end 21 can be formed through the molding process mentioned above, or through other means such as melting and shaping post 20 after attachment onto body 15.

Although the length of post 20 is not critical to the practice of the present invention, it is preferred to form post 20 to have a sufficient length to allow a propeller placed thereon to spin freely, yet not a great enough length to allow a propeller placed thereon to spin out of control. Preferably, post 20 is about 0.10 inches to about 0.40 inches in length, most preferably about 0.02 to about 0.30 inches in length. As indicated, the length of post 20 is not critical and, therefore, can be varied as desired by the practitioner.

Similarly, the diameters of post 20 and butt end 21, respectively, are not critical, but should be chosen with respect to ease and convenience of fabrication. Furthermore, the diameters should be chosen with regard to the hole diameter of a propeller to be place or mounted on post 20, as will be discussed in more detail below. Advantageously, post 20 should have a diameter of about 0.05 inches to about 0.15 inches. Most preferably, the diameter of post 20 should be about 0.08 inches to about 0.10 inches. As described, the diameter of butt end 21 should be larger than that of post 20 and is preferably about 0.10 inches to about 0.20 inches, most preferably about 0.12 inches to about 0.13 inches.

As illustrated in FIGS. 1, 3 and 4, the present invention further comprises a propeller 30. Propeller 30 can be formed of any suitable material and is preferably formed of the same material as is used to form body 15 and post 20. In this way, propeller 30 can be molded integrally with body 15 and post 20, with the ease and efficiency of doing so, and separated from body 15 and post 20 before use. Propeller 30 can be a single length of material, thereby mimicking a conventional two bladed propeller, or, advantageously, a cross-shaped member comprising a plurality of, most preferably two, transverse elements, as illustrated in FIG. 3, thereby mimicking a quadruple bladed propeller. It is most preferred that propeller 30 be formed as a single unit, both for ease of fabrication and integral stability. Furthermore, formation of propeller 30 as a single unit, even where propeller 30 comprises a cross-shaped member is preferred to maintain an even distribution of weight throughout propeller 30 to facilitate spinning of propeller 30. If propeller 30 were formed by gluing or otherwise adhering two separate elements together, an unbalanced propeller 30 could result with a concommitant interference with spinning. The thickness of propeller 30 is not critical to the practice of the present invention, but is preferably about 0.30 inches to about 0.07 inches, most preferably about 0.045 inches to about 0.049 inches.

Propeller 30 is provided with a hole or opening approximately centrally disposed therein, as illustrated in FIG. 3. The opening in propeller 30 should have a diameter larger than that of post 20 to permit propeller 30 to be placed or mounted on post 20 and spin thereabout. Moreover, if post 20 is formed with butt end 21, the opening in propeller 30 should preferably have a diameter about equal to or slightly larger than butt end 21 to permit propeller 30 to fit over butt end 21 and be mounted on post 20, yet small enough so that propeller 30 will not become disengaged from post 20 if it abuts butt end 21. Consequently, the diameter of the opening in propeller 30 should be chosen with reference to the diameters of both post 20 and butt end 21, if present. For instance, if post 20 has a diameter of about 0.09 inches and butt end 21 has a diameter of about 0.12 inches, the opening in propeller 30 should preferably have a diameter of about 0.12 inches to about 0.15 inches, most preferably about 0.12 inches to about 0.13 inches.

As illustrated in FIGS. 1 and 2, body 15 has attached thereto a plurality of upraised projections 40. When body 15 has a shape such that it has elements extending in more than one direction, such as wings when body 15 is in the shape of an airplane, upraised projections 40 can be disposed on such extending elements, although it is preferred that upraised projections be disposed on the central portion (i.e., the fuselage) of body 15.

Upraised projections 40 can be in the form of lettering, such as advertising, as illustrated in FIGS. 1, 2, 5 and 6, or ridges 140, as illustrated in FIGS. 7–9, or any other form which will permit the generation and propagation of vibrations through the longitudinal axis of body 15 through post 20 and onto propeller 30, when vibratory spinning toy 10 is used according to the present invention, as will be discussed in more detail below. Although the present disclosure is written in terms of the use of only one type of upraised projections 40 or 140 on each vibratory spinning toy 10, it will be recognized that a combination of upraised projections 40 or 140 can be advantageous utilized.

Upraised projections 40 or 140 can be attached to body 15 by appropriate adhering means, such as by gluing upraised projections 40 or 140 onto body 15, but, most preferably, upraised projections 40 or 140 are formed integrally with body 15 by molding them on body 15 by methods which are familiar to the skilled artisan. Exemplary of upraised projections 140 formed by integrally molding them with body 15 are those which are illustrated in FIG. 8. Furthermore, it will be recognized that there may be other methods of disposing upraised projections 40 on body 15, such as by a hot stamping method, which are conventional in the art.

With the increasing attention placed on child safety, regulations have been promulgated relating to the size of children's toys or parts removable from children's toys, in order to prevent a child from accidentally swallowing a toy or a part thereof and perhaps choking or having some other equally undesirable damage occur. To prevent this possiblity and to conform to such regulations, it is preferred that both body 15 and propeller 30 be of a size large enough to prevent them from fitting into a child's windpipe. It is generally accepted that a size of at least about 1.3 inches is sufficient for this purpose. The width and length of body 15, therefore, should each be at least about 1.3 inches, more preferably at least about 1.50 inches. Similarly, propeller 30 should preferably comprise a cross-shaped member which is comprised of at least two transverse elements, as illustrated in FIG. 3, with each transverse element being at least about 1.3 inches, more preferably at least about 1.50 inches in length.

In use, vibrations generated by the user are transmitted, or propagated, along the longitudinal axis of body 15 to post 20. The vibrations along post 20 cause propeller 30 to begin spinning, the more intense the vibrations, the faster the spin of propeller 30. The vibrations along the longitudinal axis of body 15 are generated by rubbing or scratching an object, preferably a fingernail or a coin longitudinally along upraised projections 40 or 140, as illustrated in FIG. 5. The rotational speed of propeller 30 as it spins is proportional to the speed with which the finger or coin, or other suitable object, is rubbed along upraised projections 40 or 140 since increased rubbing speed leads to increased intensity of vibrations propagated along post 20. Moreover, if upraised projections 40 are disposed on body 15 such that at least a central underside portion of upraised projections 40 are not securely disposed on body 15, a chirping sound (similar to that made by a cricket) can be generated when spinning toy 10 is used. This chirping sound can add to the child's enjoyment of spinning toy 10.

The rotational direction of propeller 30 can be controlled as desired. It has been found that rubbing the fingernail or coin etc. along one side of upraised projections 40 or 140 can create propeller 30 rotation in a clockwise direction while rubbing the fingernail or coin etc. along the opposite side of upraised projections 40 or 140 can create rotation of propeller 30 in a counterclockwise direction. It is a simple matter of experimentation for the user to determine which side of upraised projections 40 or 140 is to be used for the desired direction of rotation of propeller 30. Advantageously, the width of upraised projections 40 or 140 is about equal to or greater than the width of body 15 to permit the user to rub upraised projections 40 or 140 as directly from the side of upraised projections 40 or 140 as possible, to enhance the rotational control of propeller 30. Similarly, rubbing upraised projections 40 or 140 along their approximate midpoints creates rotation in either the clockwise or counterclockwise directions, depending on the angle at which the fingernail or coin, etc. approaches upraised projections 40 or 140.

The practice of the present invention provides a simple, easy to manufacture and highly amusing vibratory spinning toy 10 which can be used to advertise product or services (through lettering as upraised projections 40) and/or as marketing tools (such as by inclusion in cereal boxes, etc.). The vibratory spinning toy 10 is easy to use, does not require sophisticated assembly and can be used by children as young as three years old.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims.

I claim:

1. A vibratory spinning toy comprising a body having a plurality of upraised projections formed on a surface of said body said projections comprise recognizable lettering when a viewed is taken normal to said surface and a post disposed on said body and projecting therefrom; and a propeller disposed on said post through a centrally disposed opening.

2. The vibratory spinning toy of claim 1 wherein said propeller comprises a cross-shaped member having a plurality of elements transverse to each other.

3. The vibratory spinning toy o claim 2 wherein said cross-shaped member is made of a plastic member.

4. The vibratory spinning toy of claim 3 wherein said plurality of transverse elements of said cross-shaped member are each at least about 1.3 inches in length.

5. The vibratory spinning toy of claim 1 wherein said body is in the shape of an airplane with said post projecting from the nose portion of the airplane-shaped body.

6. The vibratory spinning toy of claim 1 wherein said body is in the sahpe of an airplane with said post projecting from the nose portion of the airplane-shaped body.

7. The vibratory spinning toy of claim 1 wherein said body is in the shape of a character with said post projecting from the head portion of said character.

8. The vibratory spinning toy of claim 1 wherein said body is in the shape of a character with said post projecting from the head portion of said character.

9. The vibratory spinning toy of claim 1 wherein said body is in the shape of an eating utensil with said post projecting from the handle of said utensil.

10. The vibratory spinning toy of claim 1 wherein said body is in the shape of an eating utensil with said post projecting from the handle of said utensil.

11. The vibratory spinning toy of claim 1 wherein said body is made of a plastic material.

12. A vibratory spinning toy comprising a body in the shape of an airplane, said body having a plurality of upraised projections formed integrally on a surface of said body said projections comprise recognizable lettering when a view is taken normal to said surface and a post disposed on said body and projecting from the nose portion of said airplane shaped body; and a propeller comprising a cross-shaped member comprised of a plurality of elements transverse to each other each of which is at least about 1.3 inches in length and having a centrally disposed opening, said propeller mounted on said post.

13. The vibratory spinning toy of claim 12 wherein said body, said post and said propeller are each made of a plastic material.

14. A vibratory spinning toy comprising a body in the shape of a character selected form the group consisting of a clown and cartoon characters, said body having a plurality of upraised projections formed integrally on a surface of said body said projections comprise recognizable lettering when a view is taken normal to said surface and a post disposed on said body and projecting from the head portion of said character-shaped body; and a propeller comprising a cross-shaped member comprised of a plurality of elements transverse to each other each at least about 1.3 inches in length and having a centrally-disposed opening, said propeller mounted on said post.

* * * * *